US010897934B2

(12) United States Patent
Hirakubo

(10) Patent No.: US 10,897,934 B2
(45) Date of Patent: Jan. 26, 2021

(54) WOMAN'S UNDERGARMENT

(71) Applicant: Gold Flag Ltd., Osaka (JP)

(72) Inventor: Akiyo Hirakubo, Osaka (JP)

(73) Assignee: GOLD FLAG LTD., Osaka (JP)

( * ) Notice: Subject to any disclaimer, the term of this patent is extended or adjusted under 35 U.S.C. 154(b) by 0 days.

(21) Appl. No.: 16/633,688

(22) PCT Filed: Sep. 14, 2017

(86) PCT No.: PCT/JP2017/033292
§ 371 (c)(1),
(2) Date: Jan. 24, 2020

(87) PCT Pub. No.: WO2019/053846
PCT Pub. Date: Mar. 21, 2019

(65) Prior Publication Data
US 2020/0170311 A1 Jun. 4, 2020

(51) Int. Cl.
*A41C 3/00* (2006.01)

(52) U.S. Cl.
CPC ..... *A41C 3/0021* (2013.01)

(58) Field of Classification Search
CPC .... A41C 3/0021; A41C 3/0014; A41C 3/0028
USPC ..... 450/59
See application file for complete search history.

(56) References Cited

U.S. PATENT DOCUMENTS 2,131,213 A 9/1938 Becker et al.
2,222,687 A * 11/1940 Rosenthal ..... A41F 1/006 2/325
3,698,399 A * 10/1972 Hand ..... A41C 3/0021 450/59
5,897,422 A 4/1999 McGee
8,128,457 B2 * 3/2012 Reinisch ..... A41C 3/0057 450/59

FOREIGN PATENT DOCUMENTS

| | | | |
|---|---|---|---|
| GB | 844064 | A | 8/1960 |
| JP | S58-140113 | U | 9/1983 |
| JP | S59-153305 | U | 10/1984 |
| JP | 2008050735 | A | 3/2008 |
| JP | 2010-275660 | A | 12/2010 |
| JP | 2011080165 | A | 4/2011 |

(Continued)

OTHER PUBLICATIONS

Office Action dated Dec. 30, 2019 for corresponding Canadian Application No. 3,063,692.

(Continued)

*Primary Examiner* — Timothy K Trieu
(74) *Attorney, Agent, or Firm* — Lucas & Mercanti, LLP

(57) ABSTRACT

A woman's undergarment prevents brassiere cups for receiving breasts from sliding upward and prevents the breasts from spilling out of the brassiere cups, even if the wearer moves her body in any direction. A woman's undergarment with brassiere cups includes the brassiere cups, cup cover pieces, a support panel, side belts and, and straps. The cup cover pieces are each disposed to cover an outer surface of the brassiere cup and separated from the outer surface of the brassiere cup. Only a lower edge of the brassiere cup is sewn to a lower edge of the cup cover piece.

3 Claims, 16 Drawing Sheets

(56) References Cited

FOREIGN PATENT DOCUMENTS

| | | | |
|---|---|---|---|
| JP | 2014196582 | A | 10/2014 |
| JP | 2015190079 | A | 11/2015 |
| JP | 2015212437 | A | 11/2015 |
| JP | 2016069763 | A | 5/2016 |
| JP | 6051618 | B2 | 12/2016 |

OTHER PUBLICATIONS

International Search Report dated Nov. 21, 2017 for Application No. PCT/JP2017/033292 and English translation.
Notice of Reasons for Refusal dated May 9, 2018 for corresponding Japanese Application No. 2018-516585 and English translation.
EPO, Extended European Search Report for the corresponding European Patent Application No. 17925528.6, dated Aug. 28, 2020.

* cited by examiner

[FIG. 1]
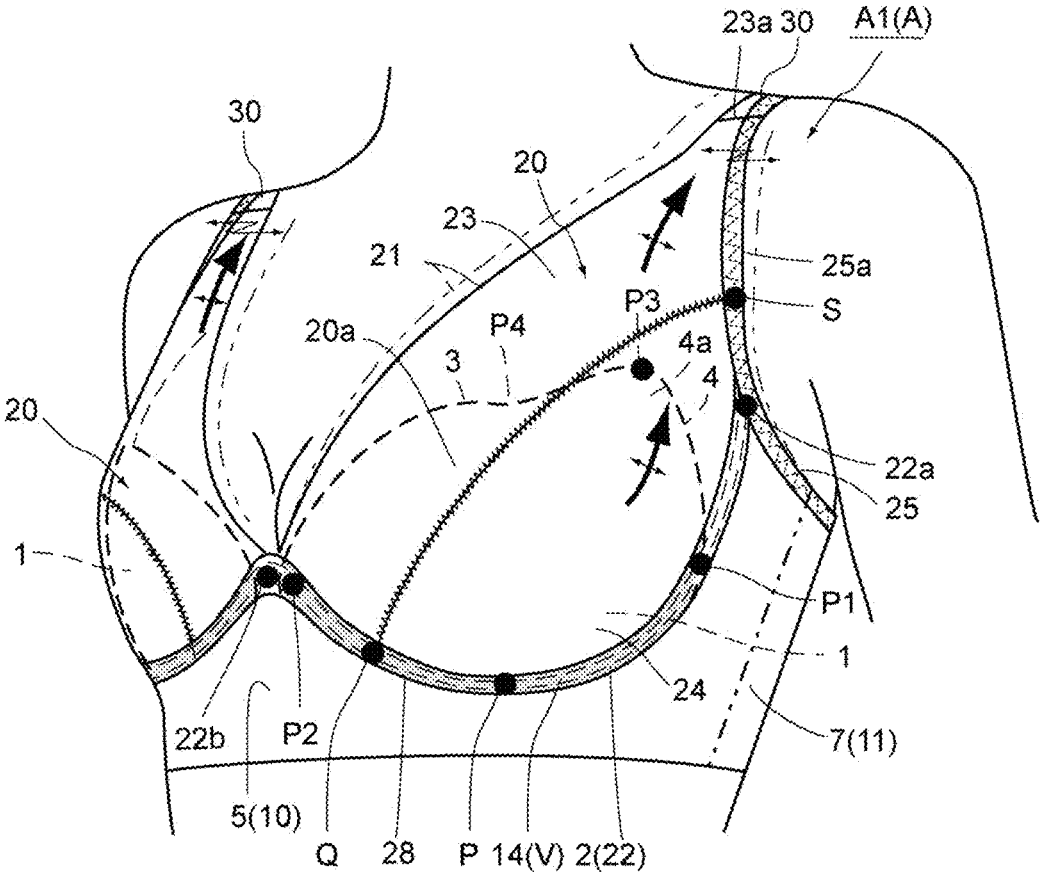

[FIG. 2]
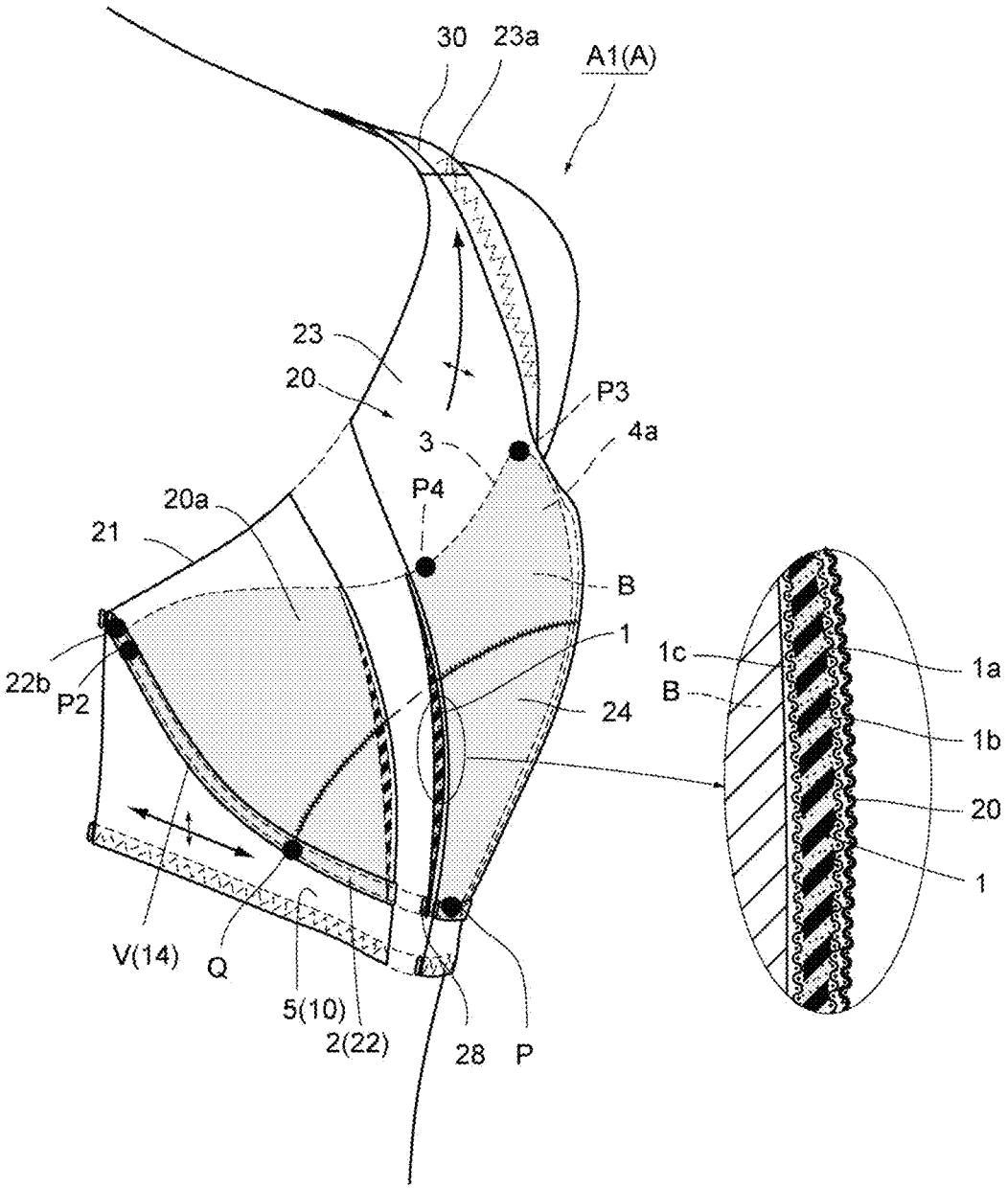

[FIG. 3]
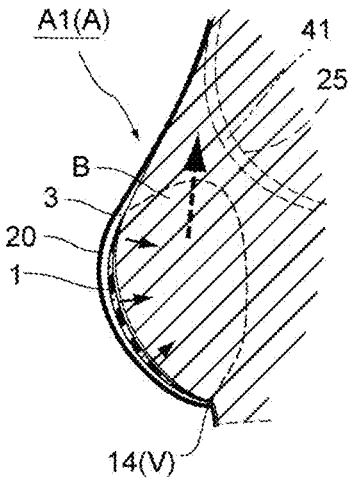
[FIG. 4]
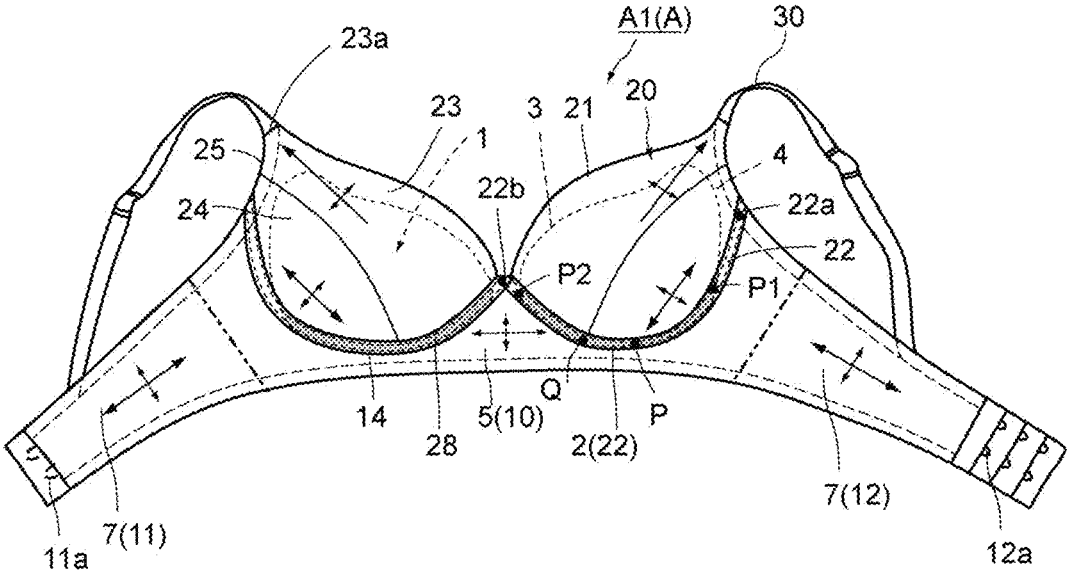

[FIG. 5]
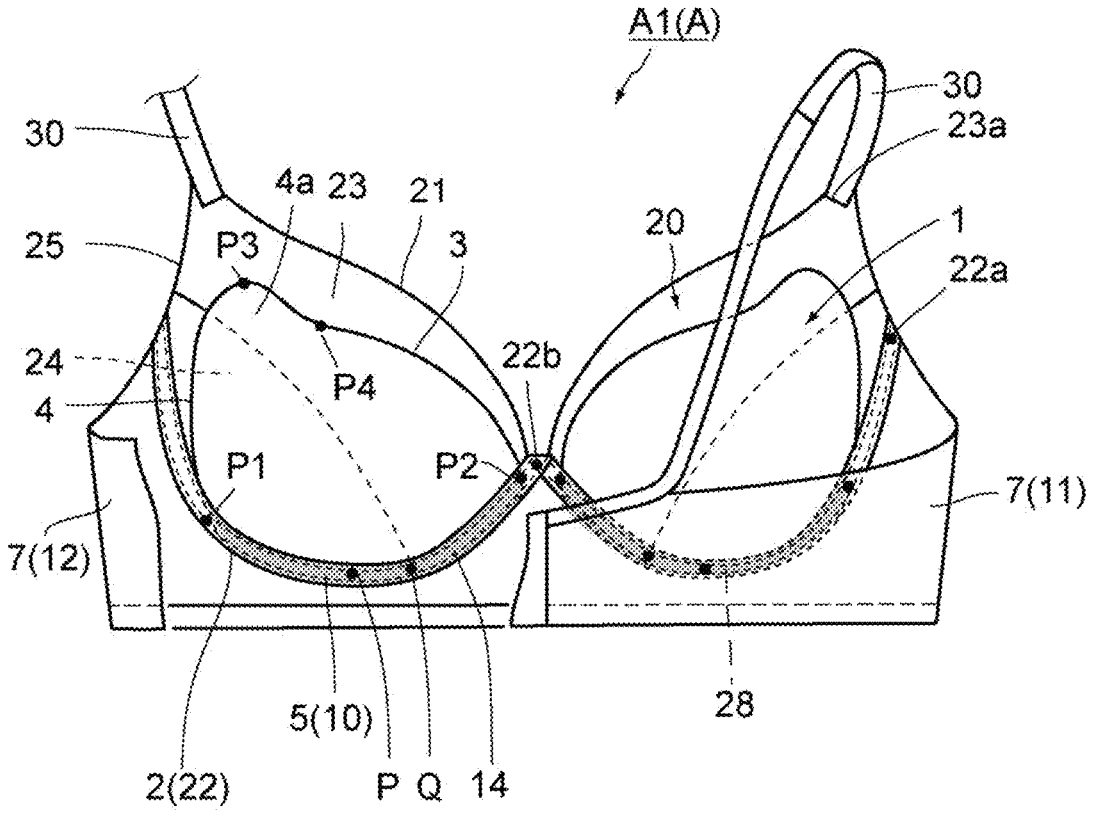

[FIG. 6]
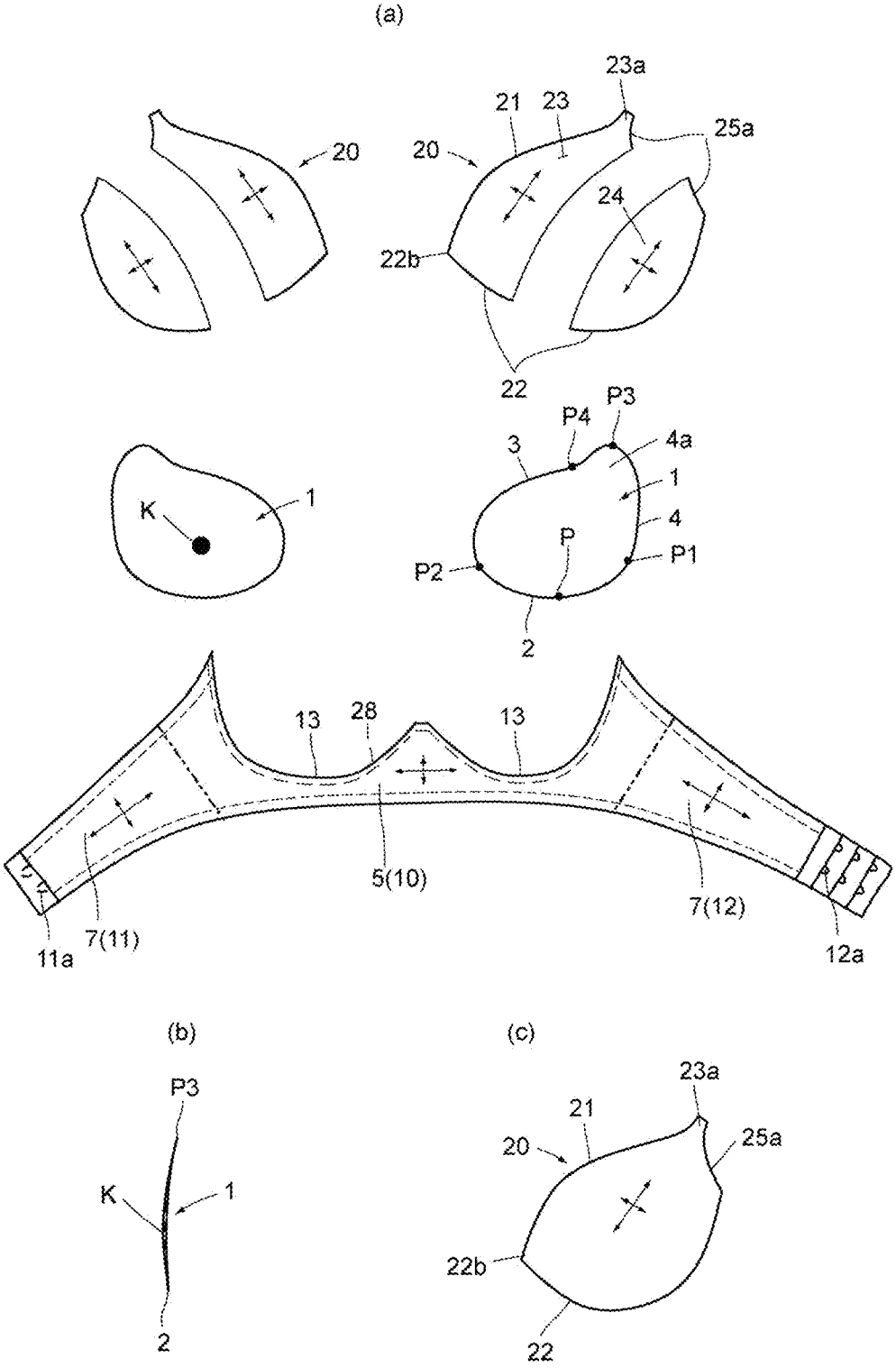

[FIG. 7]
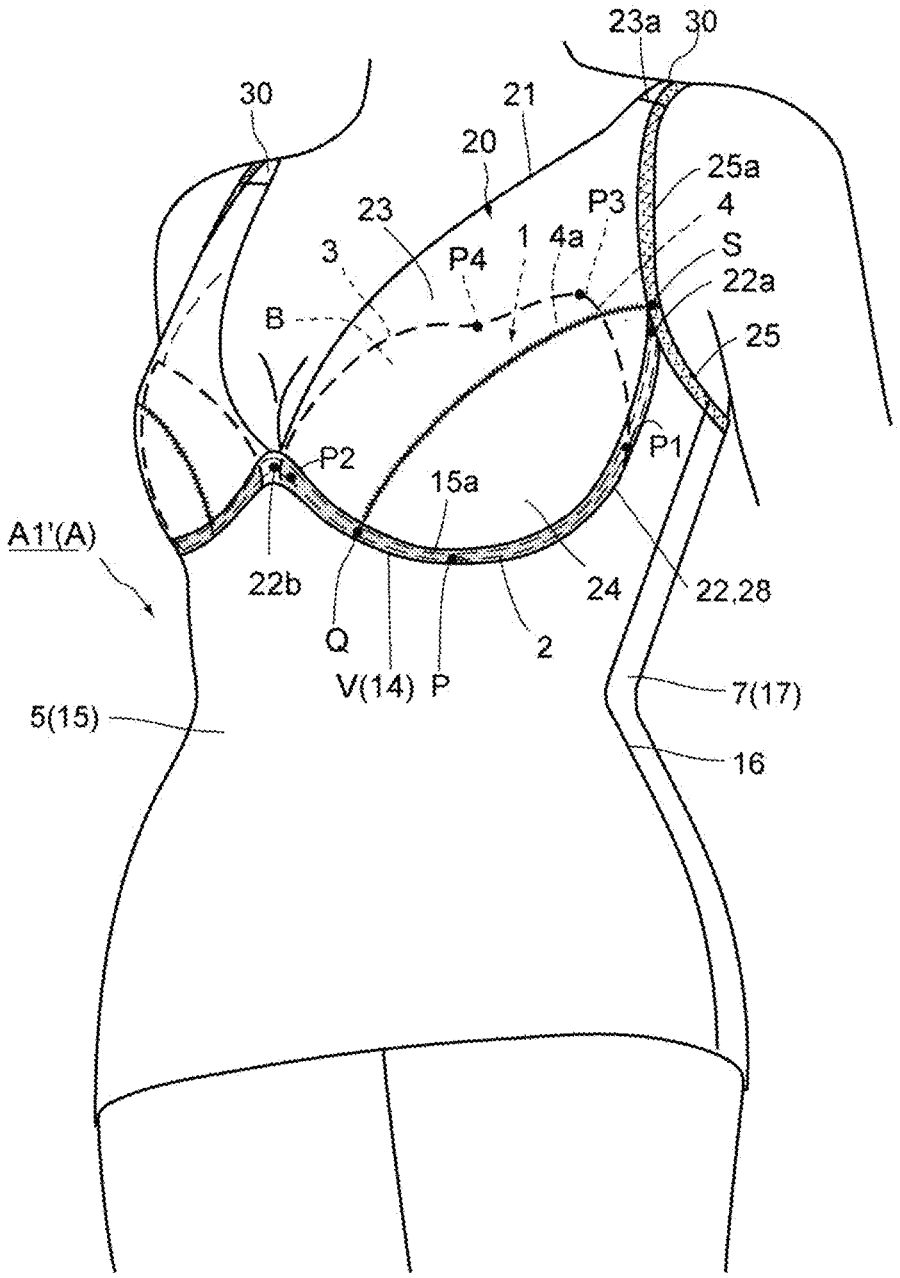

[FIG. 8]
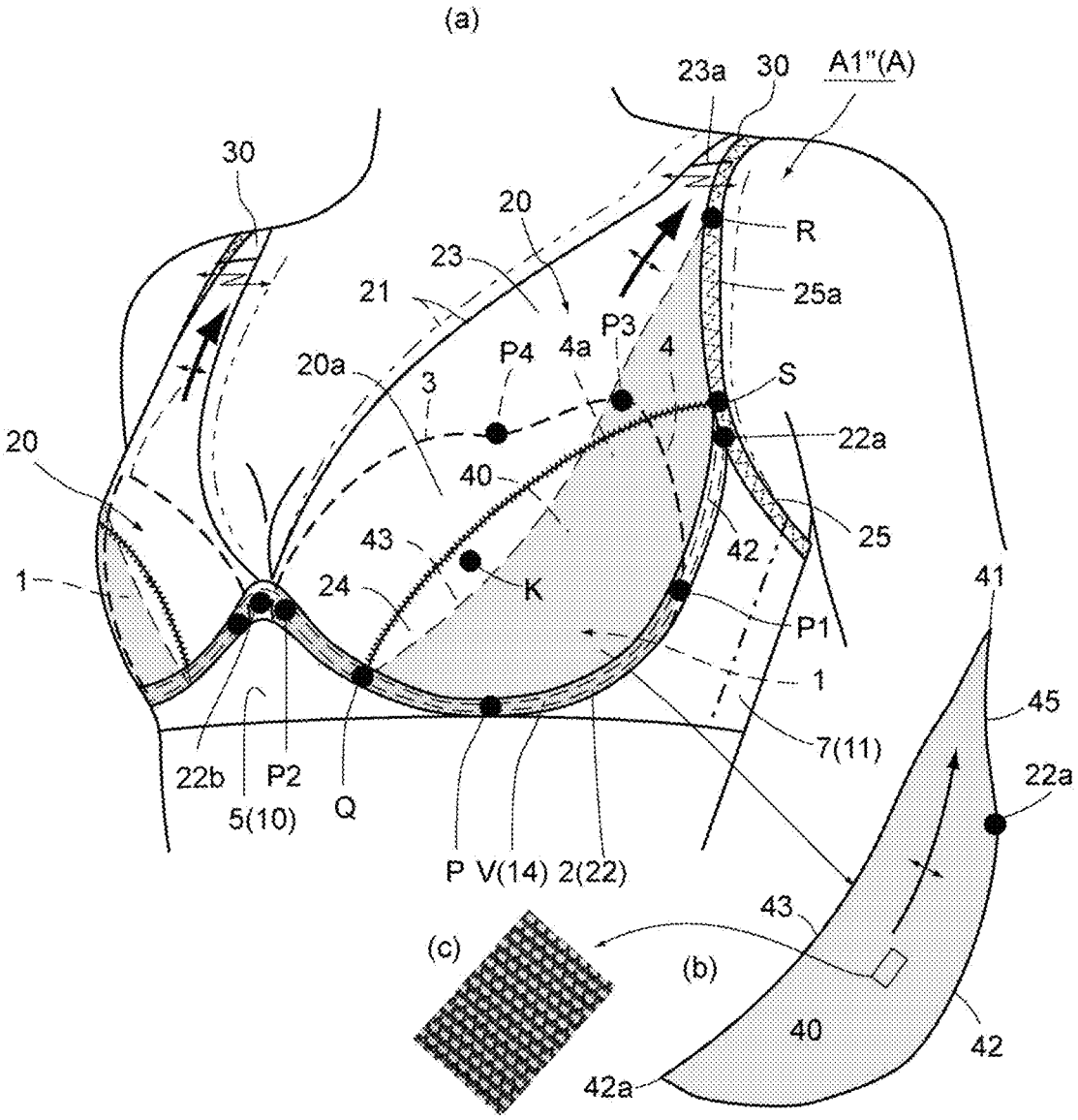

[FIG. 9]
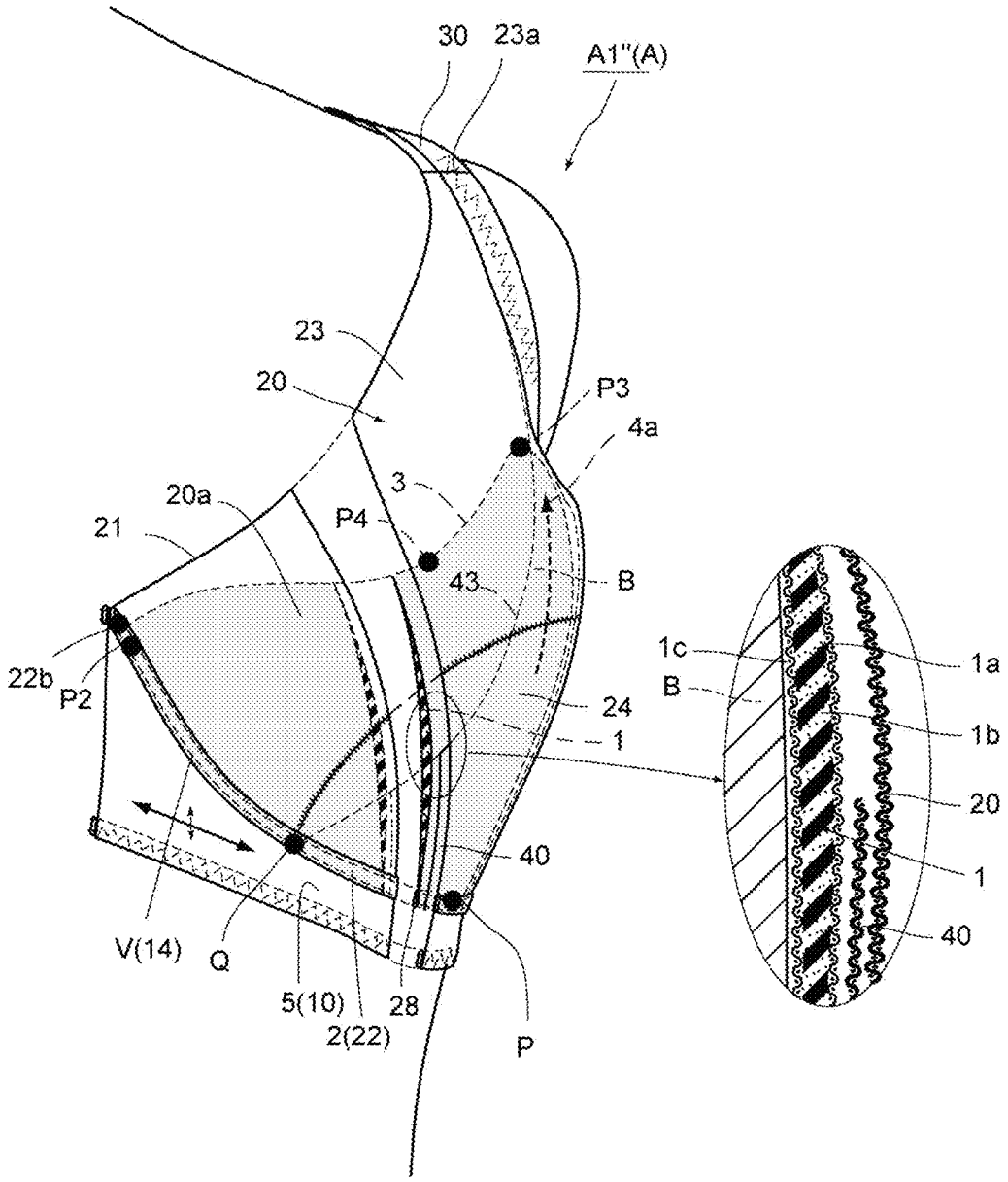

[FIG. 10]
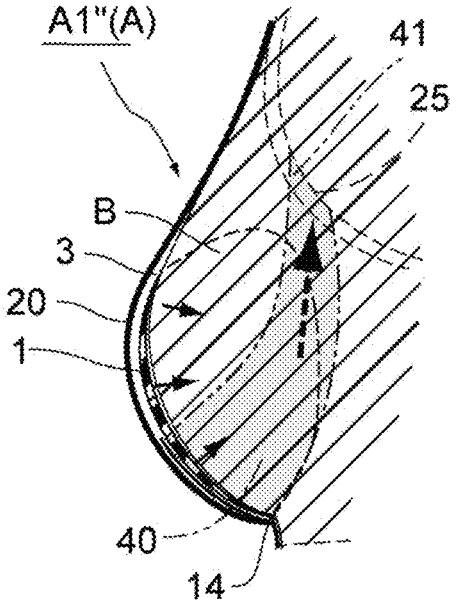

[FIG. 11]
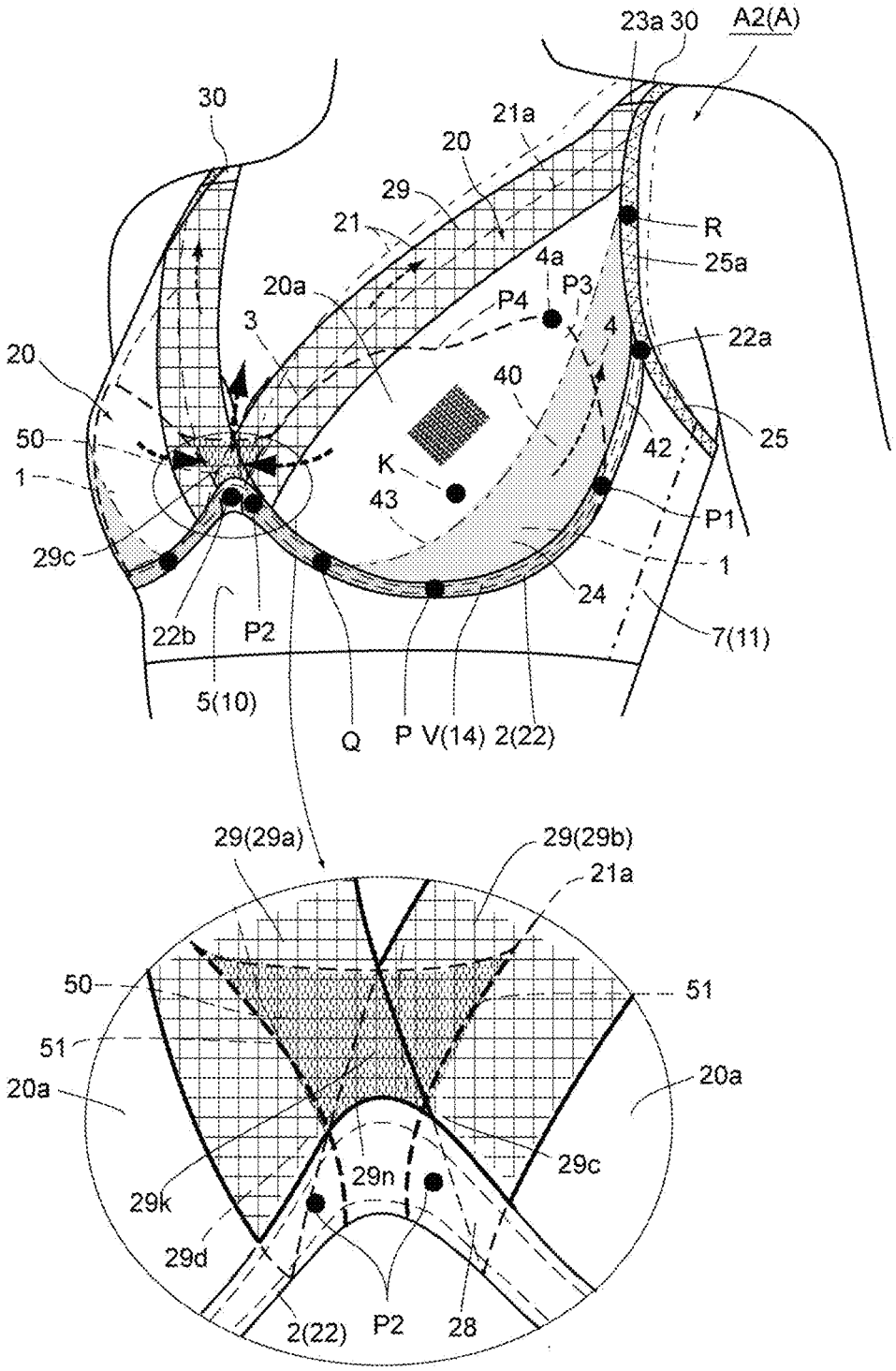

[FIG. 12]
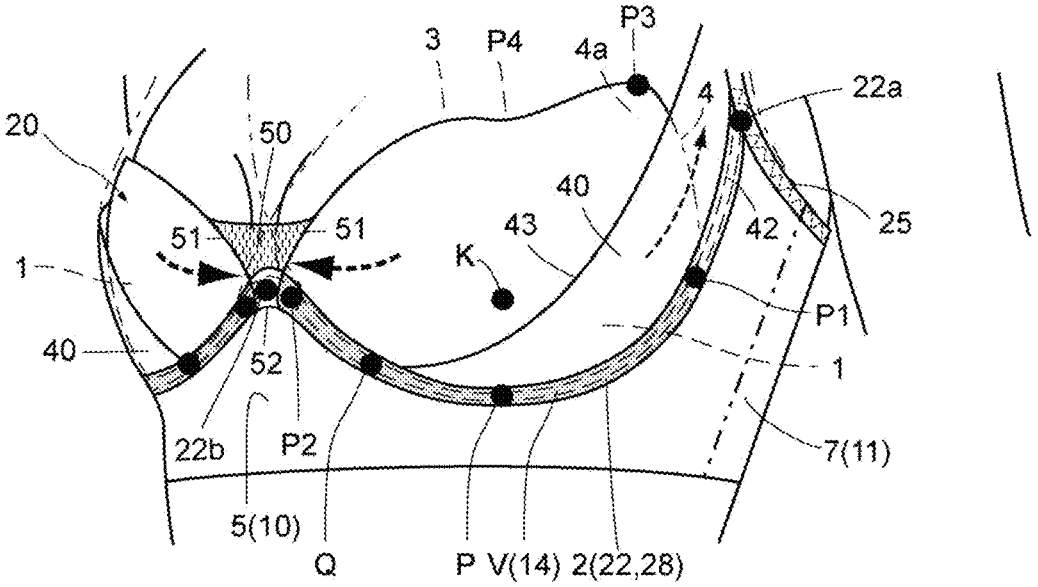

[FIG. 13]
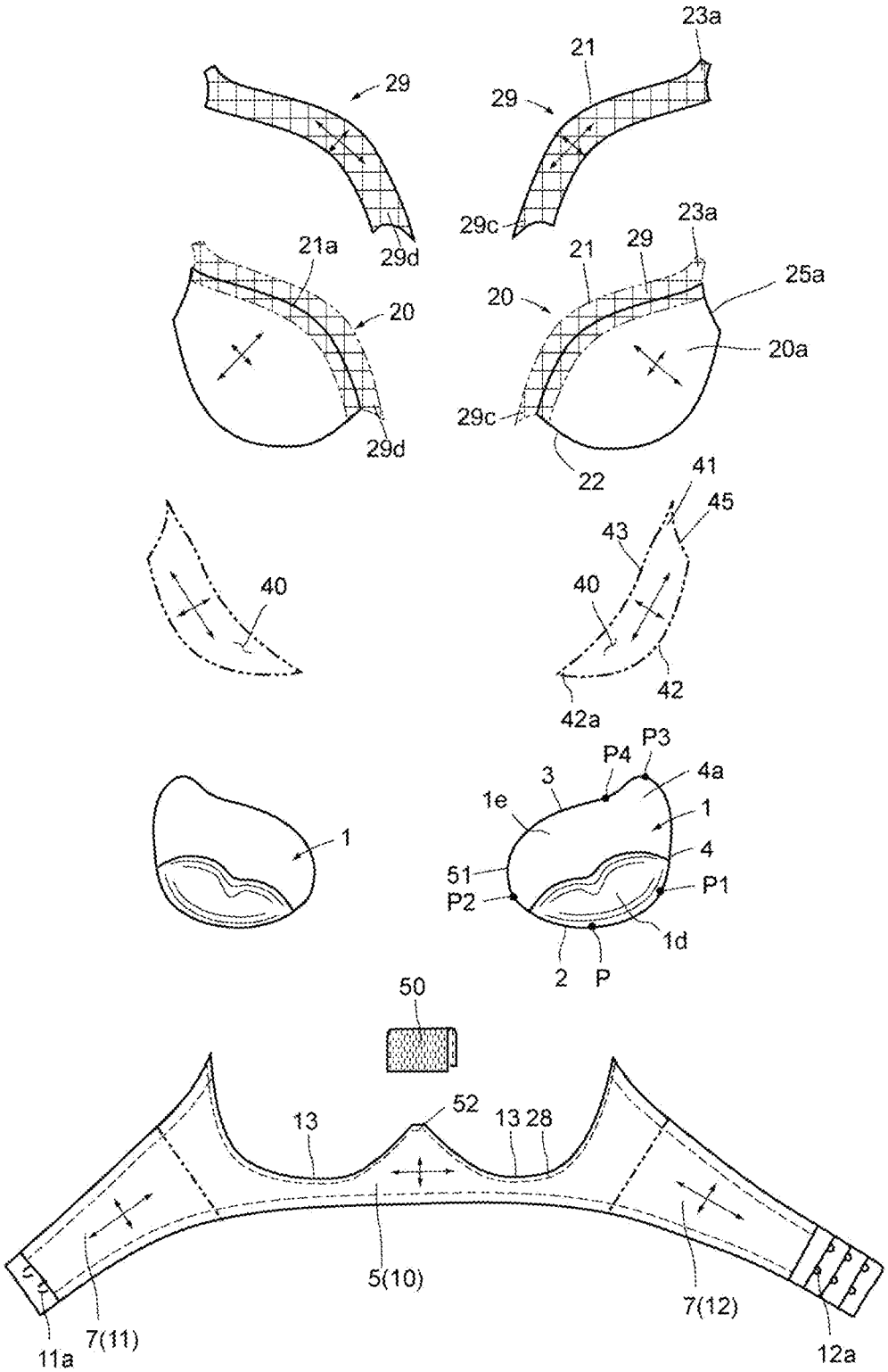

[FIG. 14]
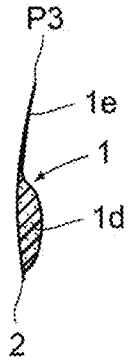
[FIG. 15]
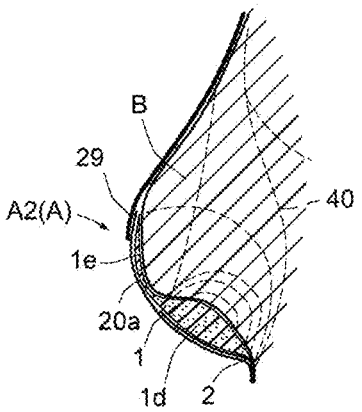

[FIG. 16]
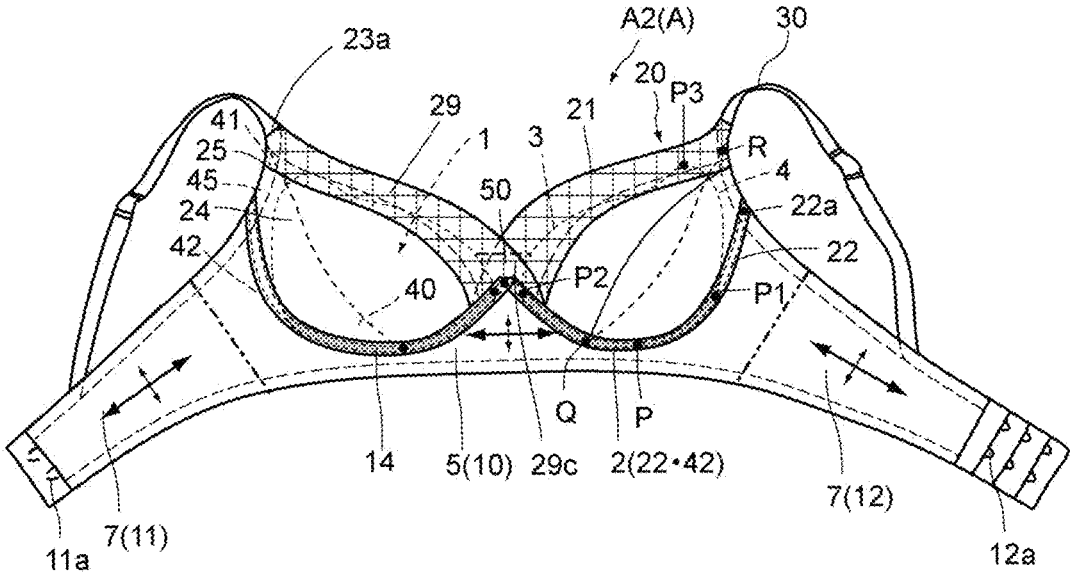
[FIG. 17]
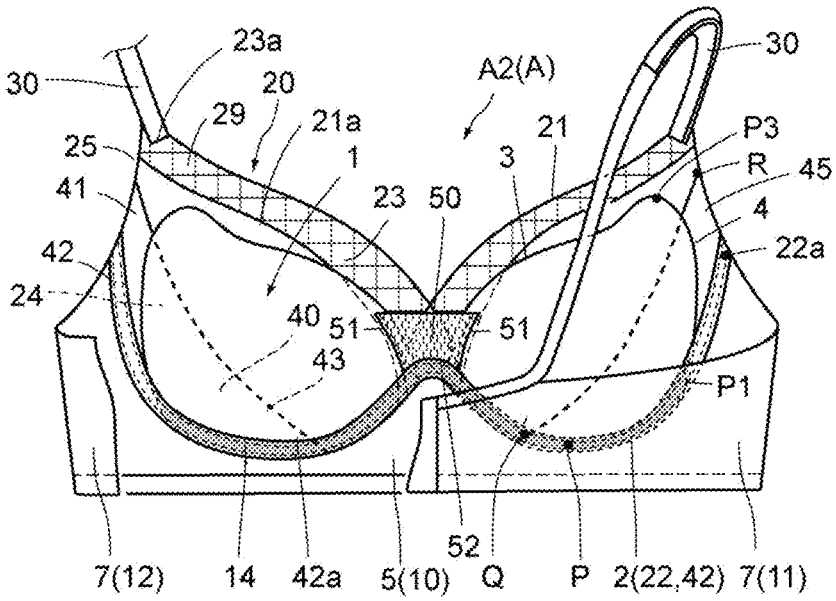

[FIG. 18]
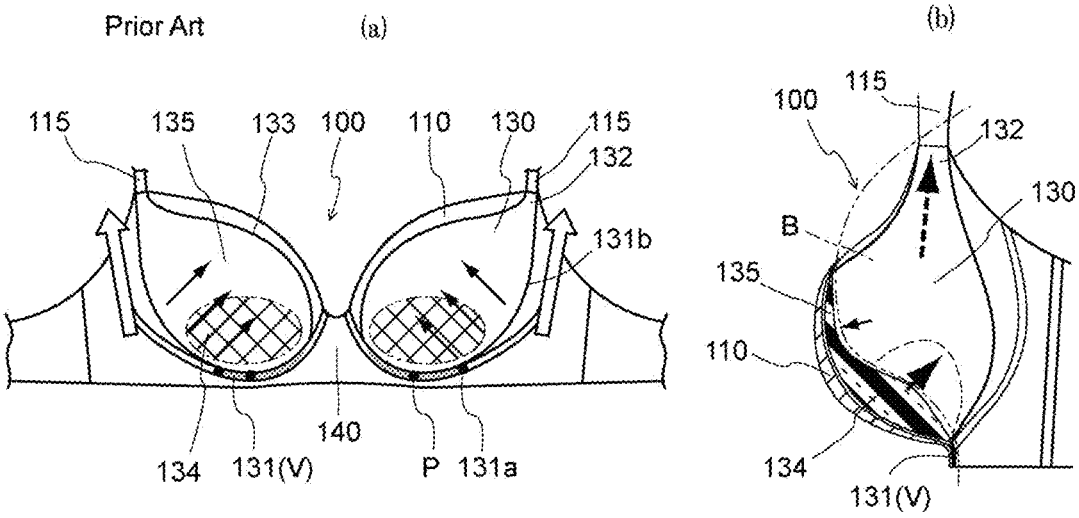

[FIG. 19]
Prior Art (a)
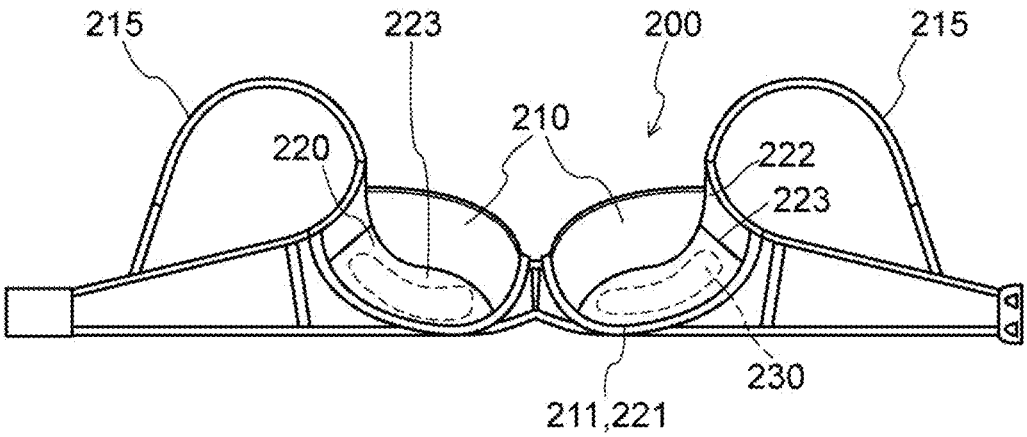
(b)
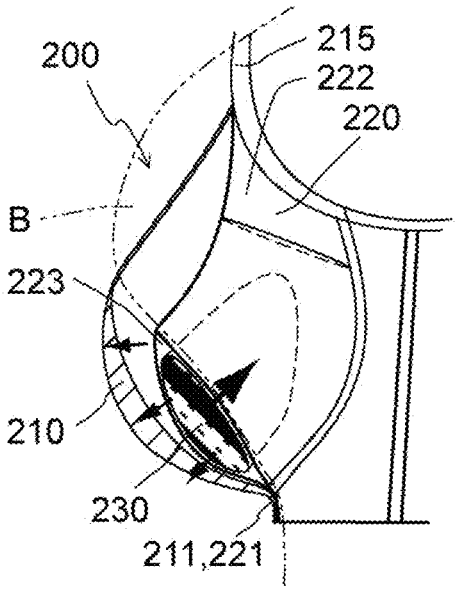

WOMAN'S UNDERGARMENT

CROSS REFERENCE TO RELATED APPLICATION

This Application is a 371 of PCT/JP2017/033292 filed on Sep. 14, 2017, which is incorporated herein by reference.

TECHNICAL FIELD

The present invention relates to women's undergarments with brassiere cups, such as brassieres and camisoles.

BACKGROUND ART

One of the important functions of brassiere cups of a woman's undergarment with brassiere cups is a function of shaping the wearer' breasts by pushing the breasts in the brassiere cups toward the sternum in the center of the chest and uplifting them so as to form an ample bust line.

A brassiere 100 of Patent Literature 1 (FIGS. 18(*a*) and (*b*)) includes brassiere cups 110 and pads 130 each disposed behind the brassiere cup 110 and having a size large enough to receive a breast B but slightly smaller than the brassiere cup 110 not to be exposed to the outside. As seen from FIG. 18, a portion of the lower edge 131 (gray-shaded portion) of this pad 130 including a point corresponding to the lowest point P of a barge scan line (under-breast curve) V is sewn to a support panel 140, and an underarm-side upper portion 132 of the upper edge 133 of the pad 130 extending toward a strap 115 is connected to the strap 115. Therefore, a portion of the upper edge 133 other than the underarm-side upper portion 132, and an edge portion 131*b* of the lower edge 131 extending from the underarm-side sewing end 131*a* to the strap 115 are free edges detached from the brassiere cup 110. Since this pad 130 serves to push the breast B received therein toward the sternum in the center of the chest and upward, the lower half 134 of the pad 130 is formed thicker than the upper half 135 thereof. The lower half 134 of the pad 130 is an encircled portion with a diagonal grid pattern.

The outer surface of the above-described pad 130 is separated from the inner surface of the brassiere cup 110. However, as described above, a portion of the lower edge 131 of the pad 130 including the point corresponding to the lowest point P of the barge scan line V is sewn to the support panel 140 and the underarm-side upper portion 132 of the pad 130 is connected to the strap 115, that is, the pad 130 is supported at two points. Therefore, when the brassiere 100 of Patent Literature 1 is worn, both the pad 130 and the brassiere cup 110 are pulled upward on the underarm side (in a direction toward the shoulder, i.e., in a direction of a hollow arrow in FIG. 18) by the pull-up force of the strap 115. When the pad 130 is brought into close contact with the breast B by the pull-up force of the strap 115, the pad 130 scoops the breast B from below on the underarm side toward the sternum side (in directions indicated by black arrows in FIG. 18 and the thicker lower half 134 of the pad 130 pushes the breast B upward. This pad 130 has not only the function of pushing up the breast but also the pull-up function of a lift-up piece 220 of Patent Literature 2 to be described next.

In a brassiere 200 of Patent Literature 2, a less stretchable lift-up piece 220 for pulling up a breast is provided behind a brassiere cup 210 configured to receive the breast B and is hidden by the brassiere cup 210 (FIGS. 19(*a*) and (*b*)). The entire length of the lower edge 221 of this lift-up piece 220 is sewn to the lower edge 211 of the brassiere cup 210, and the underarm-side upper portion 222 of the lift-up piece 220 is sewn to a strap 215.

The intended effect of this brassiere 200 is that, when the brassiere 200 is worn, both the underarm-side upper portions 222 of the lift-up pieces 220 and the brassiere cups 210 are pulled up by the straps 215, the breasts B in the brassiere cups 210 are pushed up toward the center of the chest, and thereby the volume of the breasts B are increased. Each of the lift-up pieces 220 is provided with a pad insertion pocket 223 for receiving a pad 230 for increasing the volume of the breast B.

CITATION LIST

Patent Literature

[PTL 1] Japanese Patent No. 6051618

[PTL 2] Japanese Laid-Open Patent Publication No. 2008-050735

SUMMARY OF INVENTION

Technical Problem

Since the underarm-side upper portion 132 of the pad 130 of the brassiere 100 and the underarm-side upper portion 222 of the lift-up piece 220 of the brassiere 200 are connected to the strap 115 and the strap 215, respectively, as described above, both of these brassieres 100 and 200 can pull up the breasts B effectively. However, due to the connection of the underarm-side upper portions 132 and 222 to the straps 115 and 215, the pad 130 is constrained at the connection point to the strap 115 by the brassiere cup 110 located in front of the pad 130, while the lift-up piece 220 is constrained at the connection point to the strap 215 by the brassiere cup 210 located in front of the lift-up piece 220.

As a result, when the wearer of the brassiere 100 or 200 moves her body, the brassiere cup 110 or 210 moves in accordance with the movement of the strap 115 or 215, and then the pad 130 or the lift-up piece 220 that receives the breast B is pulled by the strap 115 or 215 and moves in accordance with the movement of the brassiere cup 110 or 210.

Due to these movements, the breast B thus received may spill out of the pad 130 or the lift-up piece 220, or the lower edge 131 of the pad 130 or the lower edge 221 of the lift-up piece 220 may slide up over the barge scan line V. This phenomenon is particularly evident in the case of a wireless brassiere without an underwire (not shown) in the lower edge 131 of the pad 130 or the lower edge 221 of the lift-up piece 220.

In Patent Literature 2, since the lift-up piece 220 directly supports and pulls up a portion of the breast B from below, the movement of the body as described above is likely to cause deformation of the breast B.

The present invention has been made in view of the above conventional art, and it is an object of the present invention to provide a woman's undergarment that prevents brassiere cups for receiving breasts from sliding upward and prevents the breasts from spilling out of the brassiere cups, even if the wearer moves her body in any direction.

Solution to Problem

Examples of a women's undergarment A with brassiere cups 1 according to the present invention include a brassiere A1, a brassiere A1", a brassiere A2, and a camisole A1'. A first aspect of the present invention is a woman's undergarment A according to a first embodiment, (without lift-up pieces 40, FIG. 1 to FIG. 7) including:

a pair of left and right brassiere cups 1 each configured to receive a breast B and having a lower edge 2, a side edge 4, and an upper edge 3, the lower edge 2 being downwardly curved, the side edge 4 rising from an underarm-side end P1 of the lower edge 2 toward the upper edge 3, the upper edge 3 extending from a sternum-side end P2 of the lower edge 2 to an upper end P3 of the side edge 4;

cup cover pieces 20 each disposed to cover an outer surface of the brassiere cup 1 and separated from the outer surface of the brassiere cup 1;

a back piece 7 extending from lateral sides of the cup cover pieces 20 and configured to cover a wearer's back; and straps 30 each extending from the cup cover piece 20 to the back piece 7, wherein only the lower edge 2 of the brassiere cup 1 extending from the underarm-side end P1 to the sternum-side end P2 is sewn to a lower edge 22 of the cup cover piece 20, and the side edge 4 and the upper edge 3 of the brassiere cup 1 are free edges detached from the cup cover piece 20, the woman's undergarment A further includes a cup connecting piece 50 for connecting abutting portions of the left and right brassiere cups 1, each of the cup cover pieces 20 includes: a cover piece body 20*a* that covers the outer surface of the brassiere cup 1; and an upper edge reinforcing strip 29 sewn to an upper edge 21*a* of the cover piece body 20*a*, and a lower end portion 29*c* of one of the upper edge reinforcing strips 29*a* and a lower end portion 29*d* of another of the upper edge reinforcing strips 29*b* overlap each other to form a double-layer region, and the overlapping lower end portions 29*c*, 29*d* are sewn together to a lower edge of the cup connecting piece 50.

In the woman's undergarment A described above, only the lower edge 2 of the brassiere cup 1 is sewn to the lower edge 22 of the cup cover piece 20, while the side edge 4 and the upper edge 3 thereof are free edges detached from the cup cover piece 20. Therefore, the brassiere cup 1 is not constrained by the movement of the cup cover piece 20 when it is worn. Thus, it is possible to prevent the brassiere cup 1 from sliding upward and the breast B from spilling out of the brassiere cup 1.

When this woman's undergarment A is worn, the left and right brassiere cups 1 that receive the breasts B are pulled laterally in the left and right directions by the pull-up forces. However, the cup connecting piece 50 acts against the pull-up forces and prevents the left and right brassiere cups 1 from being laterally spaced apart or separated from each other.

When the woman's undergarment A is worn, a resultant force of the pull-up forces of pulling the upper edge reinforcing strips 29*a* and 29*b* upward toward the left and right shoulders lifts the lower edge 29*n* of the cup connecting piece 50 and thus reinforces the effect of the cup connecting piece 50, i.e., the effect of lifting the brassiere cups 1.

A second aspect of the present invention is a woman's undergarment A according to a modification of the first embodiment (further including lift-up pieces 40) (FIG. 8 to FIG. 10). More specifically, the claimed woman's undergarment A (A1") further includes lift-up pieces 40 each provided between the cup cover piece 20 and the brassiere cup 1. In this undergarment A, a lower edge 42 of the lift-up piece 40 is sewn to a portion of the lower edge 22 of the cup cover piece 20, the portion extending from a point Q between a sternum-side end P2 of the cup cover piece 20 and a lowest point P of the cup cover piece 20 at least to an underarm-side end P1 of the cup cover piece 20, an underarm-side upper end portion 41 serving as an upper end of the lift-up piece 40 is attached to the strap 30 or a portion of an edge of the cup cover piece 20, the portion being located between the underarm-side end P1 and a connecting portion (a strap connecting portion 23*a*) between the strap 30 and the cup cover piece 20, and an upper edge 43 of the lift-up piece 40 is a free edge detached from the cup cover piece 20 and the brassiere cup 1 and passes through or laterally below a highest top position K of the brassiere cup 1.

In the woman's undergarment A described above, the brassiere cups 1 each having free upper edge 3 and free side edge 4 can support the breasts B from below and pull them up. Thus, well-shaped breasts can be obtained.

A third aspect of the present invention is a woman's undergarment A according to a modification of the present invention, as set forth in the first or second embodiment.

In the woman's undergarment A, the overlapping lower end portions 29*c* and 29*d* of the upper edge reinforcing strips 29*a* and 29*b*, including the double-layer region 29*k*, are provided to cover the cup connecting piece 50.

Thereby, the cup connecting piece 50 does not detract from the appearance of the woman's undergarment A because the cup connecting piece 50 is not visible from outside.

Advantageous Effects of the Invention

According to the woman's undergarment of the present invention, since the brassiere cup is provided separately from the cup cover piece, the brassiere cup can be independent of the cup cover piece. With this structure, when the wearer of this woman's undergarment moves or bends her body, the cup cover piece is also moved by the tension or slack of the strap in accordance with the movement of the body such as leaning forward or backward. On the other hand, the brassiere cup provided independently of the cup cover piece remains in close contact with the breast and does not move because it is not constrained by the movement of the cup cover piece.

Furthermore, since the lift-up piece is provided in front of the brassiere cup as described above, the lift-up piece can support the entire brassiere cup that receives the breast therein from below and pull it up so as to shape the breast to a natural rounded shape.

In addition, when the brassiere is worn, the upper edge reinforcing strips and the cup connecting piece can prevent lateral separation of the brassiere cups.

BRIEF DESCRIPTION OF DRAWINGS

FIG. 1 is a perspective view of a brassiere (without lift-up pieces) according to a first embodiment of the present invention on a wearer.

FIG. 2 illustrates a vertical center sectional view of the brassiere on the wearer shown in FIG. 1 and an enlarged view of a portion of the brassiere.

FIG. 3 is a vertical center sectional view of a brassiere cup of FIG. 2.

FIG. 4 is a front view of the brassiere according to the first embodiment.

FIG. 5 is a back view of FIG. 4, in which a portion of a back piece is cut away.

FIG. 6 illustrates: (a) an exploded view of the brassiere of FIG. 4; (b) a vertical sectional view of the brassiere cup; and (c) a front view of another example of the cup cover piece (a single-piece cover piece).

FIG. 7 is a perspective view of a camisole according to a modification of the first embodiment of the present invention on a wearer.

FIG. 8 illustrates: (a) a perspective view of a brassiere (with lift-up pieces) according to a modification of the first embodiment of the present invention on a wearer; (b) a perspective view of the lift-up piece; and (c) an enlarged view of the lift-up piece.

FIG. 9 illustrates a vertical center sectional view of the brassiere on the wearer shown in FIG. 8 and an enlarged view thereof.

FIG. 10 is a vertical center sectional view of the brassiere cup of FIG. 9.

FIG. 11 is a perspective view of a brassiere (with a cup connecting piece) according to a second embodiment of the present invention on a wearer.

FIG. 12 is a perspective view of the brassiere of FIG. 11, from which the cup cover pieces are removed.

FIG. 13 is an exploded view of the brassiere of FIG. 11.

FIG. 14 is a vertical sectional view of a brassiere cup used in the brassiere of FIG. 11.

FIG. 15 is a vertical center sectional view of the brassiere on the wearer shown in FIG. 11.

FIG. 16 is a front view of a brassiere according to the second embodiment.

FIG. 17 is a back view of FIG. 16, in which a portion of a back piece is cut away.

FIG. 18 illustrates: (a) a back view of a brassiere described in Patent Literature 1; and (b) a vertical sectional view thereof.

FIG. 19 illustrates: (a) a back view of a brassiere described in Patent Literature 2; and (b) a vertical sectional view thereof.

DESCRIPTION OF EMBODIMENTS

Hereinafter, a woman's undergarment A of the present invention will be described with examples. Examples of the woman's undergarment A of the present invention include all types of undergarments with brassiere cups 1, such as brassiere-type, camisole-type, and other types of undergarments. In this description, brassiere-type and camisole-type undergarments are described as examples. Specific examples of the woman's undergarment A include: an undergarment without lift-up pieces 40 as a first embodiment; an undergarment with the lift-up pieces 40 as a modification of the first embodiment; and an undergarment obtained by additionally providing a cup connecting piece 50 and upper edge reinforcing strips 29 to the undergarment of the first embodiment, as a second embodiment.

First Embodiment

The first embodiment of the woman's undergarment A of the present invention is shown in FIG. 1 to FIG. 7. An example of the woman's undergarment A of the first embodiment is a brassiere A1 or a camisole A1'. First, the brassiere A1 will be described (FIG. 1 to FIG. 6).

The brassiere A1 includes a pair of left and right brassiere cups 1, cup cover pieces 20, a support panel 10 as an optional component, back pieces 7 (side belts 11 and 12 in the example shown in these figures), and straps 30.

The brassiere cups 1 are each designed to directly cover a breast B, or if the wearer is fat, to receive the breast B including flab gathered from the back. The brassiere cup 1 has an outwardly curved bowl shape, and its lower edge 2 is downwardly curved so as to fit along the barge scan line V of the wearer. The lowest point of the lower edge 2 is denoted by P. The side edge 4 rises from the underarm-side end P1 of the lower edge 2 toward the upper edge 3 to form a laterally curved arc with a large radius of curvature. The upper edge 3 is an edge between the upper end P3 of the side edge 4 and the sternum-side end P2 of the lower edge 2 and has an S-shaped snaking line in the present embodiment. When the upper edge 3 is divided into three or four equal segments, the point at which the curve of the upper edge 3 changes its shape (i.e., the inflection point) is located at a point P4 one-third or one-fourth distance from the upper end P3 (i.e., two-third or three-fourth distance from the sternum-side end P2). A shorter portion of the upper edge 3 from the upper end P3 to the point P4 forms a gentle upward curve, and a longer portion of the upper edge 3 from the sternum-side end P2 to the point P4 also forms a gentle upward curve. These upward curves are connected smoothly to a downward curve at the point P4.

The lower edge 2, the upper edge 3, and the side edge 4 described above are connected smoothly by arcs (see FIG. 6). The entire length of the lower edge 2 of the brassiere cup 1 extending from the underarm-side end P1 to the sternum-side end P2 is sewn to the lower edge 22 of the cup cover piece 20 to be described below.

The brassiere cup 1 may have various shapes, such as a shell shape (not shown) and a heart shape as shown in FIG. 6, depending on the breast B.

As shown in FIG. 6(*b*), the brassiere cup 1 has a thickness maximum at the center thereof and gradually decreasing toward the periphery (i.e., a thickness decreasing almost monotonically), and thus forms a gently, outwardly curved outer surface. The highest top position of the outer surface of the brassiere cup 1 is denoted by K. A portion of the inner surface corresponding to a portion around the top position K is configured to receive a nipple.

In another example of the brassiere cup 1, as shown in FIG. 14, the upper half 1*e* thereof has a thickness gradually decreasing toward the upper edge 3 as shown in FIG. 6(*b*) but the lower half 1*d* thereof is thicker than the upper half 1*e*.

As shown in an enlarged view in FIG. 2, in the present embodiment, the material of the brassiere cup 1 is a sheet-like foam-laminated fabric or foam-backed fabric having a three-layer structure composed of an interlayer 1*b* made of a foam material and thin fabric layers as an outer layer 1*a* and an inner layer 1*c* attached to the interlayer 1*b*. A thin fabric layer may be attached only to the outer surface of the interlayer, although not shown here. In the present embodiment, a urethane resin is used as the foam material.

The brassiere cup 1 is formed as follows. An original foam-laminated or foam-backed fabric is cut into a piece of a desired size, the piece is formed into a desired shape by hot press molding, and then burrs are removed by cutting. Thus, a cup of the desired shape is obtained. It should be understood that the materials for the brassiere cup 1 are not limited to those described above, and any other known materials such as a nonwoven fabric and a double Raschel fabric may be used.

The cup cover piece 20 is a thin cloth disposed to cover the entire surface of the brassiere cup 1, and it may be composed of two pieces as shown in FIG. 6(*a*) or it may be a single piece as shown in FIG. 6(*c*). When the cup cover piece 20 is composed of two pieces, it has the same shape as that shown in FIG. 6(*c*) if the pieces are sewn together.

First, the two-piece cup cover piece 20 is described. In this case, the cup cover piece 20 is composed of an upper part 23 and a lower part 24. As the material of this cup cover piece 20, a fabric which is less stretchable and thus unsuitable for hot press molding, such as a lace fabric, is used. The upper part 23 and the lower part 24 are sewn together at the connection portion, and the resulting cloth is formed into an outwardly curved shape to fit the brassiere cup 1.

In contrast, the single-piece cup cover piece 20 shown in FIG. 6(*c*) is formed into a shape that conforms to the shape of the brassiere cup 1 by hot press molding. As the material of this cup cover piece 20, a fabric that can be formed by hot press molding, such as a power net fabric made of polyurethane fibers, is used.

The cup cover piece 20 has an upper edge 21, a lower edge 22 and an edge 25*a* serving as a (front) portion of an armhole 25. As seen from FIG. 1, the lower edge 22 has a downward "U" shape along the barge scan line V. One end of the lower edge 22 is an armhole-side end 22*a*, the other end thereof is a connecting end 22*b*, and the lowest point thereof is P. The left and right cup cover pieces 20 are connected at their connecting ends 22*b*. The edge 25*a* serving as a portion of the armhole 25 rises from the armhole-side end 22*a* and extends to the strap connecting portion 23*a*, and the upper edge 21 extends between the strap connecting portion 23*a* and the connecting end 22*b*.

The lower edge 22 of the cup cover piece 20 is longer than the lower edge 2 of the brassiere cup 1, and the lower edge 2 of the brassiere cup 1 is sewn to a portion of the lower edge 22 of the cup cover piece 20 between the armhole-side end 22*a* and the connecting end 22*b*. The lower edge 2 of the brassiere cup 1 from its underarm-side end P1 to its sternum-side end P2 is sewn to the lower edge 22 of the cup cover piece 20.

When the upper part 23 and the lower part 24 of the two-piece cup cover piece 20 of the present embodiment are sewn together, the lower sewing point Q of the sewing line is fixed to a point that is closer to the connecting end 22*b* at the center than the lowest point P is (i.e., a point located between the lowest point P and the connecting end 22*b* in the present embodiment). For example, the specific position of the lower sewing point Q is preferably in a range of 2 cm to 4 cm from the lowest point P, and more preferably in a range of 1 cm to 3 cm therefrom.

The upper sewing point S of the sewing line between the upper part 23 and the lower part 24 is fixed to a point located between the armhole-side end 22*a* of the lower edge 22 and the strap connecting portion 23*a*.

The upper part 23 of the cup cover piece 20 is more stretchable obliquely upward toward the strap connecting portion 23*a* (toward the shoulder) but less stretchable in a direction perpendicular to the obliquely upward direction, as shown by thick arrows in FIG. 4. Like the upper part 23, the lower part 24 is more stretchable in its longitudinal direction from the lowest point P toward the armhole 25 than in a direction perpendicular to the longitudinal direction. Thus, the cup cover piece 20 as a whole is more stretchable in a direction parallel to the upper edge 21 toward the strap connecting portion 23*a* than in a direction perpendicular to that parallel direction. The same applies to the single-piece cup cover piece 20. As shown in FIG. 6(*c*), the cup cover piece 20 is more stretchable obliquely upward toward the strap connecting portion 23*a* (toward the shoulder) and less stretchable in a direction perpendicular to the obliquely upward direction.

The cup cover piece 20 is disposed to cover the entire outer surface of the brassiere cup 1 and the cup cover piece 20 is separated from the outer surface of the brassiere cup 1. The upper edge 3 and the side edge 4 of the brassiere cup 1 are not sewn to the cup cover piece 20, and only the lower edge 2 of the brassiere cup 1 is sewn to the lower edge 22 of the cup cover piece 20. The lower edge 2 of the brassiere cup 1 from its underarm-side end P1 to its sternum-side end P2 is sewn, as described above, and the side edge 4 rises from the underarm-side end P1 located on the medial side of the armhole 25 of the cup cover piece 20.

In the brassiere A1 of the present embodiment, a support panel 10 serving as a front panel 5 is sewn to the lower edges 22 of the cup cover pieces 20. The support panel 10 has sewing edges 13 forming a W shape to be sewn to the lower edges 22 of the connected left and right cup cover pieces 20, for example, as shown in FIG. 1 and FIG. 6(*a*). Side belts 11 and 12 serving as back pieces 7 extend left and right from the lateral sides of the support panel 10.

In the embodiment shown in these figures, the support panel 10 and the side belts 11 and 12 are made of a fabric such as a lace fabric. The end of one side belt 11 is provided with male engaging members 11*a*, while the end of the other side belt 12 is provided with female to-be-engaged members 12*a*. The support panel 10 and the side belts 11 and 12 are more elastically stretchable in their longitudinal (lengthwise) directions than in their transverse (widthwise) directions, as shown by arrows in FIG. 4.

In the present embodiment, the lower edges 22 of the cup cover pieces 20, the lower edges 2 of the brassiere cups 1, the sewing edges 13 of the support panel 10, and a non-stretchable tape 28 are stacked on top of one another and sewn together, and thus a narrow strip-like W-shaped cup supporting portion 14 is formed, as shown in FIG. 4. The cup supporting portion 14 is thick and flexible but not stretchable in its longitudinal direction. Therefore, the cup supporting portion 14 is not provided with an underwire.

In the embodiment shown in FIG. 4, the support panel 10 is provided. However, the support panel 10 may be omitted by connecting the connecting ends 22*b* of the left and right cup cover pieces 20, placing the non-stretchable tape 28 on the lower edges 22 of the cup cover pieces 20, and sewing them together so as to increase the strength. In this case, the side belts 11 and 12 are each connected to a portion, of the lower edge 22 of the cup cover piece 20, extending from the armhole-side end 22*a* to the lowest point P, although not shown in this figure.

The straps 30 are respectively connected at their one ends to the strap connecting portions 23*a* of the left and right cup cover pieces 20, and their other ends are each connected to the center of the upper edge of the side belt 11 (or 12) on the side of the corresponding cup cover piece 20.

Next, the operations of the brassiere A1 on a wearer will be described. When the brassiere A1 is worn, the side belts 11 and 12 are connected by the engaging members 11*a* and the to-be-engaged members 12*a* and thus the support panel 10 stretches and slightly constricts the chest of the wearer, while the straps 30 pull up the cup cover pieces 20 toward the shoulders, as shown by thick arrows (see FIG. 1). The cup supporting portion 14 fits under the barge scan lines V of the breasts B and supports the breasts B from below. Since the cup supporting portion 14 is not provided with an underwire, it softly touches the barge scan lines V of the breasts B.

Since the brassiere cup 1 is disposed behind the cup cover piece 20 independently of the cup cover piece 20, it is brought into close contact with the breast B and snugly covers the entire breast, when pressed by the cup cover piece 20 from above. Unlike the conventional pad 130, the brassiere cup 1 of FIG. 3 does not have a thick portion (the lower half 134) for pushing the lower portion of the breast B near the barge scan line V but has an approximately crescent-shaped cross section as described above. Therefore, the breast covered by the brassiere cup 1 is formed into a naturally rounded shape without being partially pushed and deformed. At the same time, the breast is pushed toward the sternum side by the pull-up operation of the cup cover piece 20, and thus an ample bust line is formed.

When the wearer twists or bends her body or leans backward, the chest is also deformed in accordance with the movement of the body. Since the cup cover piece 20 of the brassiere A1 is suspended by the strap 30 from the shoulder, the cup cover piece 20 is also pulled and deformed when the body is deformed. On the other hand, the support panel 10 of the brassiere A1 stays in contact with the wearer's chest as described above. Therefore, even if the wearer moves, the support panel 10 is less affected by the deformation of the body, and the cup supporting portion 14 fits under the barge scan lines V and remains fixed in that position to keep supporting the breasts B.

The lower edge 2 of the brassiere cup 1 is sewn and serves as a portion of the cup supporting portion 14, but the upper edge 3 and the side edge 4 of the brassiere cup 1 are separated and freed from the cup cover piece 20. Therefore, the brassiere cup 1, which is pressed by the cup cover piece 20 from above, holds the breast B in close contact therewith and moves with the breast B, without being constrained by the movement of the cup cover piece 20. In other words, even if the wearer moves her body in any direction, the brassiere cup 1 keeps holding the breast B independently of the cup cover piece 20 and thus the breast B does not spill out of the brassiere cup 1.

In addition, even if the cup cover piece 20 is pulled by the strap 30, the brassiere cup 1 is not directly pulled by the strap 30 or the cup cover piece 20 and holds the breast B independently of them. Therefore, the cup supporting portion 14 does not slide up over the barge scan lines V, although it is not provided with an underwire. Thus, the brassiere A1 of the present invention is more flexible with respect to the movement of the body than the conventional brassiere 100 or 200.

Modification 1 of First Embodiment

A modification of the first embodiment of the present invention is the case where the woman's undergarment A is a camisole A1', as shown in FIG. 7. The brassiere cups 1 and the cup cover pieces 20 are the same as those of the brassiere A1, but the front panel 5 and the back pieces 7 are replaced by a front body piece 15 and a back body piece 17, respectively. The upper edge 15*a* of the front body piece 15 is sewn to the lower edges 22 of the cup cover pieces 20, the lower edges 2 of the brassiere cups 1, and the non-stretchable tape 28, and thus they form the cup supporting portion 14. In this example, the back body piece 17 is sewn to the side edges 16 of the front body piece 15. The body part composed of the front body piece 15 and the back body piece 17 may be replaced by a single tubular body part, although not shown. The body part composed of the front body piece 15 and the back body piece 17 may be modified in various ways.

The straps 30 are connected to the strap connecting portions 23*a* of the cup cover pieces 20 and predetermined portions of the back body piece 17. The operations and effects of Modification 1 on the wearer are the same as those of the first embodiment.

Modification 2 of First Embodiment

This modification is a brassiere A1" obtained by adding lift-up pieces 40 to the brassiere A1 of the first embodiment, as shown in FIG. 8 to FIG. 10. The lift-up pieces 40 are each a crescent-shaped piece, as indicated with a leader line in FIG. 8, and disposed between the brassiere cup 1 and the cup cover piece 20. The lift-up piece 40 has a lower edge 42, an upper edge 43, and an armhole sewing edge 45 that connects the upper end (i.e., an underarm-side upper end portion 41) of the upper edge 43 and the upper end of the lower edge 42 and is sewn to a portion (a front side) of the armhole 25.

The lower edge 42 of the lift-up piece 40 is sewn to a portion, of the cup cover piece 20, extending from the lower sewing point Q to the armhole-side end 22*a* on the armhole 25 of the woman's undergarment A1". The armhole sewing edge 45 of the lift-up piece 40 is sewn to the entire edge (not shown) from the armhole-side end 22*a* to the strap connecting portion 23*a* or a portion of the edge from the armhole-side end 22*a* to an armhole midway point R that is a point located between the armhole-side end 22*a* and the strap connecting portion 23*a*. This sewing line is provided to allow the lift-up piece 40, in conjunction with the cup cover piece 20, to scoop the brassiere cup 1 from below. The lift-up piece 40 is provided in such a manner that the upper edge 43 thereof passes through or laterally below the top position K of the brassiere cup 1 on the wearer's breast. As shown in FIG. 8, the lift-up piece 40 is more stretchable in its longitudinal direction parallel to the upper edge 43 than in a direction perpendicular to the longitudinal direction.

As the material of the lift-up piece 40, an elastically stretchable material, such as a power net fabric as mentioned above, is used.

Next, the operations of the brassiere A1" worn on a wearer will be described. The brassiere cup 1 functions in the same manner as in the first embodiment, but in this example, the operation of the lift-up piece 40 is added.

More specifically, the upper edge 3 and the side edge 4 of the brassiere cup 1 are not sewn to the cup cover piece 20 and thus the brassiere cup 1 is separated from the cup cover piece 20 as shown in the first embodiment. Therefore, the brassiere cup 1 itself holds the breast B in close contact therewith independently of the cup cover piece 20.

The lift-up piece 40 itself is known as shown in Patent Literature 2. However, since the lift-up piece 40 of the present invention is provided in a lateral region of the brassiere cup 1 and adjacent to the lower edge 2 thereof (i.e., in a region below a line connecting the lower sewing point Q and the strap connecting portion 23*a* or the armhole midway point R, that is, a region located below the connecting line passing through or laterally below the highest top position, the top position K, of the brassiere cup 1), it functions to scoop the brassiere cup 1 from below and push it medially. The function of scooping the brassiere cup 1 enhances the function of pushing the breast B in the brassiere cup 1 toward the center of the chest without impairing the independence of the brassiere cup 1. Since the lift-up piece 40 is provided in a lateral region of the brassiere cup 1, it pulls up the entire brassiere cup 1, which means that the lift-up piece 40 can pull up the breast B without deforming its rounded shape.

This configuration can be applied to women's undergarments with brassiere cups, such as camisoles.

Next, the second embodiment of the present invention will be described with reference to FIG. 11 to FIG. 17. The second embodiment is substantially the same as the first embodiment, except that the structure of the cup cover piece 20 is different from that of the first embodiment and a cup connecting piece 50 is additionally provided. Also in the second embodiment of the present invention, the lift-up pieces 40 may or may not be used, but in either case, other configurations are the same as those of the first embodiment and thus the description of the first embodiment is applied to the second embodiment.

The brassiere cups 1 of the first embodiment are not connected to each other but their lower edges 2 are sewn to the lower edges 22 of the cup cover pieces 20, the tape 28, and the support panel 10. Therefore, when the woman's undergarment A is worn, the cup cover pieces 20 are pulled up by the straps 30, and the left and right brassiere cups 1 with their lower edges 2 being sewn to the cup cover pieces 20 are also likely to be slightly separated from each other laterally (or the opening angle between the upper edges 3 of the brassiere cups 1 is likely to increase). This is more likely to occur when the wearer has large breasts B.

So the cup connecting piece 50 is used. The cup connecting piece 50 is a piece of cloth for connecting the left and right brassiere cups 1 adjacent to each other at their adjacent portions (abutting portions) 51 near the sternum-side ends P2 of the upper edges 3. As the cup connecting piece 50, a highly stretchable double-folded fabric such as a power net fabric is used. The cup connecting piece 50 is more elastically stretchable in a direction connecting the left and right brassiere cups 1 than in a direction perpendicular to that connecting direction. The side edges of the cup connecting piece 50 are sewn to the adjacent portions 51 near the sternum-side ends P2 as described above, and the lower edge of the cup connecting piece 50 is sewn to a portion, of the long and narrow W-shaped cup supporting portion 14, including an inverted U-shaped portion 52 located between the left and right sewing edges 13 of the support panel 10.

Since the cup connecting piece 50 is used to connect the left and right brassiere cups 1, it is exposed to the outside through a space between the brassiere cups 1. In this embodiment, the shape, structure, and location of the cup cover pieces 20 are changed to hide the cup connecting piece 50.

As shown in FIG. 13, the cup cover pieces 20 of the second embodiment are each composed of two pieces: a cover piece body 20*a*; and an upper edge reinforcing strip 29. For example, the cover piece body 20*a* is a single fabric piece made of a highly stretchable fabric such as a power net fabric, and the fabric is used so that it is more elastically stretchable in a direction from the lower edge 22 toward the upper edge 21*a* than in a direction perpendicular to that direction and toward the strap connecting portion 23*a*. (It should be understood that the more stretchable direction may be reversed as shown in FIG. 1). The size of the cover piece body 20*a* is reduced by trimming the upper edge of the cup cover piece 20 of the first embodiment by 3 to 4 cm, so that the upper edge 21*a* of the cover piece body 20*a* and the upper edge 3 of the brassiere cup 1 overlap each other. The cover piece body 20*a* is formed into a curved shape by hot press molding, if necessary. The cover piece body 20*a* may be a single piece as shown in FIG. 6(*c*), but it may be composed of two pieces to form a curved shape as shown in FIG. 6(*a*).

The upper edge reinforcing strips 29 are primarily intended to cover the cup connecting piece 50 to prevent exposure of the cup connecting piece 50 to the outside, as described above, but in addition, they serve to reinforce the upper edges 21*a* of the cover piece bodies 20*a*. The upper edge reinforcing strip 29 has an upwardly curved arcuate shape with a width of 2 to 3 cm as shown in FIG. 13, and its upwardly extending upper end serves as the strap connecting portion 23*a*. Since the upper edge reinforcing strips 29 are provided to cover the cup connecting piece 50 in the present embodiment, as described above, a less stretchable fabric than a power net fabric, such as a lace fabric, is used as the material of the upper edge reinforcing strips 29.

The upper edge reinforcing strips 29 are each sewn to the upper edge 21*a* of the cover piece body 20*a*. The lower end portion 29*c* of one upper edge reinforcing strip 29*a* and the lower end portion 29*d* of the other upper edge reinforcing strip 29*b* overlap each other, so that the overlapping lower end portions 29*c* and 29*d* are sewn together to a portion, of the cup supporting portion 14, corresponding to the inverted U-shaped portion 52 of the support panel 10 and including the lower edge 29*n* of the cup connecting piece 50.

FIG. 11 shows an enlarged view of a region including that corresponding portion, in which the lower end portion 29*c* of one upper edge reinforcing strip 29*a* and the lower end portion 29*d* of the other upper edge reinforcing strip 29*b* overlap each other to form a double-layer region 29*k*. The lower end portion 29*c* (or 29*d*) of the upper edge reinforcing strip 29*a* (or 29*b*) on one side including the double-layer region 29*k* and the cup connecting piece 50 are sewn together to the adjacent portion (abutting portion) 51 near the sternum-side end P2 of the upper edge 3 of the brassiere cup 1 on the other side and the corresponding portion of the cup supporting portion 14, and vice versa.

The overlapping lower end portions including the double-layer region 29*k* has a size large enough to cover the outer surface of the cup connecting piece 50.

When this woman's undergarment A2 is worn, the left and right upper edge reinforcing straps 29 and the cover piece bodies 20*a* are pulled together toward the strap connecting portions 23*a*. The lower end portions 29*c* and 29*d* of these upper edge reinforcing strips 29*a* and 29*b* are each sewn to the adjacent portion 51 near the sternum-side end P2 on the other side. Therefore, in a front view, the left upper edge reinforcing strap 29*a* pulls the sternum-side end P2 of the right brassiere cup 1 diagonally upward left, while the right upper edge reinforcing strap 29*b* pulls the sternum-side end P2 of the left brassiere cup 1 diagonally upward right.

As a result, when the woman's undergarment A is worn, the lower edge 29*n* of the cup connecting piece 50 is lifted by the resultant force of the pull-up forces of pulling the upper edge reinforcing strips 29*a* and 29*b* upward toward the left and right shoulders. Thus, not only the effect of the cup connecting piece 50 to lift the brassiere cups 1 is reinforced but also the left and right cup cover pieces 20 and the left and right brassiere cups 1 are prevented from being laterally spaced apart from each other and thus the cleavage between the round-shaped breasts B is prevented from being overexposed. A rectangular portion shown in FIG. 8(*c*) is a mesh of the lift-up piece 40, and a rectangular portion shown in FIG. 11 is a mesh of the cup cover piece 20.

REFERENCE SIGNS LIST

A: Woman's undergarment
A1: Brassiere of First Embodiment
A1': Camisole

A1": Brassiere of Modification 1 of First Embodiment
A2: Brassiere of Second Embodiment
B: Breast
K: Top position
P: Lowest point
P1: Underarm-side end
P2: Sternum-side end
P3: Upper end of side edge
P4: Point one-third distance from upper end of side edge
Q: Point (Lower sewing point)
R: Armhole midway point
S: Upper sewing point
V: Barge scan line
1: Brassiere cup
1*a*: Outer layer
1*b*: Interlayer
1*c*: Inner layer
1*d*: Lower half
1*e*: Upper half
2: Lower edge
3: Upper edge
4: Side edge
4*a*: Adjacent portion
5: Front panel
7: Back piece
10: Support panel
11, 12: Side belts
11*a*: Engaging member
12*a*: To-be-engaged member
13: Sewing edge
14: Cup supporting portion
15: Front body piece
15*a*: Upper edge
16: Side edge
17: Back body piece
20: Cup cover piece
20*a*: Cover piece body
21: Upper edge of cup cover piece
21*a*: Upper edge of cover piece body
22: Lower edge
22*a*: Armhole-side end
22*b*: Connecting end
23: Upper part
23*a*: Strap connecting portion
24: Lower part
25: Armhole
25*a*: Edge serving as a portion of armhole
28: Tape
29, 29*a*, 29*b*: Upper edge reinforcing strips
29*c*, 29*d*: Lower end portions
29*k*: Double-layer region
29*n*: Lower edge of cup connecting piece
30: Strap
40: Lift-up piece
41: Underarm-side upper end portion
42: Lower edge of lift-up piece
42*a*: Sternum-side end
43: Upper edge
45: Armhole sewing edge
50: Cup connecting piece
51: Adjacent portion
52: Inverted U-shaped portion
100: Brassiere
110: Brassiere cup
115: Strap
130: Pad
131: Lower edge of pad
131*a*: Sewing end of lower edge
132: Underarm-side upper portion of pad
133: Upper edge of pad
134: Lower half
135: Upper half
140: Support panel
200: Brassiere
210: Brassiere cup
211: Lower edge of brassiere cup
215: Strap
220: Lift-up piece
221: Lower edge of lift-up piece
222: Underarm-side upper portion of lift-up piece
223: Pad insertion pocket
230: Pad

The invention claimed is:

1. A woman's undergarment comprising:

a pair of left and right brassiere cups each configured to receive a breast and having a lower edge, a side edge, and an upper edge, the lower edge being downwardly curved, the side edge rising from an underarm-side end of the lower edge toward the upper edge, the upper edge extending from a sternum-side end of the lower edge to an upper end of the side edge;

cup cover pieces each disposed to cover an outer surface of the brassiere cup and separated from the outer surface of the brassiere cup;

a back piece extending from lateral sides of the cup cover pieces and configured to cover a wearer's back; and straps each extending from the cup cover piece to the back piece, wherein only the lower edge of the brassiere cup extending from the underarm-side end to the sternum-side end is sewn to a lower edge of the cup cover piece, and the side edge and the upper edge of the brassiere cup are free edges detached from the cup cover piece, the woman's undergarment further comprises a cup connecting piece fo connecting abutting portions of the left and right brassiere cups, each of the cup cover pieces includes: a cover piece body that covers the outer surface of the brassiere cup; and an upper edge reinforcing strip sewn to an upper edge of the cover piece body, and a lower end portion of one of the upper edge reinforcing strips and a lower end portion of another of the upper edge reinforcing strips are overlapping lower end portions of the upper edge reinforcing strips that overlap each other to form a double-layer region, and both of the overlapping lower end portions of the upper edge reinforming strips are sewn to a lower edge of the cup connecting piece.

2. The woman's undergarment according to claim 1, wherein the overlapping lower end portions of the upper edge reinforcing strips, including the double-layer region, are provided to cover the cup connecting piece.

3. The woman's undergarment according to claim 1, further comprising lift-up pieces each provided between the cup cover piece and the brassiere cup, wherein a lower edge of the lift-up piece is sewn to a portion of the lower edge of the cup cover piece, the portion extending from a point between a sternum-side end of the cup cover piece and a lowest point of the cup cover piece at least to an underarm-side end of the cup cover piece, an underarm-side upper end portion serving as an upper end of the lift-up piece is attached to the strap or a portion of an edge of the cup cover piece, the portion being located between the underarm-side end and a connecting portion between the strap and the cup cover piece, and an upper edge of the lift-up piece is a free edge detached from the cup cover piece and the brassiere cup and passes through or laterally below a highest top position of the brassiere cup.

* * * * *